US006618872B1

(12) United States Patent
Fan

(10) Patent No.: US 6,618,872 B1
(45) Date of Patent: Sep. 16, 2003

(54) CONTROLLING DEVICE FOR A SHOWERHEAD

(76) Inventor: Chen-Yueh Fan, Room F/23, 4th Fl., No. 5, Sec. 4, Hsinyi Rd., Taipei (TW)

( * ) Notice: Subject to any disclaimer, the term of this patent is extended or adjusted under 35 U.S.C. 154(b) by 0 days.

(21) Appl. No.: 10/237,999

(22) Filed: Sep. 9, 2002

(51) Int. Cl.[7] ..... A47K 3/20; B05B 1/00
(52) U.S. Cl. ..... 4/615; 4/559; 4/605; 239/444
(58) Field of Search ..... 4/559, 596, 597, 4/604, 605, 619; 239/444–447

(56) References Cited

U.S. PATENT DOCUMENTS 3,112,073 A * 11/1963 Larson et al. ..... 239/446
3,461,870 A * 8/1969 Linge ..... 604/118
4,273,289 A * 6/1981 Jette ..... 239/458
4,311,279 A * 1/1982 Jette ..... 239/562
4,360,160 A * 11/1982 Jette ..... 239/289
4,398,668 A * 8/1983 Jette ..... 239/414
4,881,282 A * 11/1989 George et al. ..... 4/604
5,220,697 A * 6/1993 Birchfield ..... 4/559
5,823,441 A * 10/1998 Nicholson ..... 239/317

* cited by examiner

*Primary Examiner*—Charles E. Phillips
(74) *Attorney, Agent, or Firm*—Jackson Walker L.L.P.

(57) ABSTRACT

A controlling device for a showerhead with a body includes a push rod, a controlling valve and a collar. The push rod is movably mounted in the showerhead body. The controlling valve is hollow to allow accommodate the push rod and has a first opening, a second opening communicating with the first opening and an radial hole radially defined in a side face of the controlling valve to communicate with both the first opening and the second passage. The collar is adapted to connect to the showerhead body and has a neck. The push rod extends through the controlling valve and the collar and has a head selectively received in the first opening to block communication between the main passage and the first opening so that water is able to selectively flow out of the showerhead body via the first outlet.

7 Claims, 7 Drawing Sheets

CONTROLLING DEVICE FOR A SHOWERHEAD

BACKGROUND OF THE INVENTION

1. Field of the Invention

The present invention relates to a controlling device for a showerhead, and more particularly to a controlling device that allows short people to use the showerhead readily.

2. Description of Related Art

With reference to FIG. 7, a conventional controlling device for a showerhead (70) is firmly attached to a wall. The controlling device is a valve (71) securely and pivotally mounted in the showerhead (70) so a person can control water flowing to a first outlet (72) or a second outlet (73). However, because the showerhead (70) normally is attached to the wall high above the ground, short children are not able to reach the valve (71) to control the water. Therefore, an adult must assist a child when ever the valve (71) must be operated.

To overcome the shortcomings, the present invention provides an improved controlling device for a showerhead to mitigate and obviate the aforementioned problems.

SUMMARY OF THE INVENTION

The primary objective of the present invention is to provide an improved controlling device for a showerhead. The controlling device enables children to use the showerhead readily.

Another objective of the present invention is to provide a clamping device so that when the controlling device is activated, the clamping device is able to provide necessary force to support the push rod to keep water flowing in a specific direction.

To accomplish the foregoing objective, the controlling device of the present invention includes a push rod, a controlling valve and a collar. The push rod has a head with an annular seal mounted around the head. The controlling valve has a first opening, a second opening communicating with the first opening and a radially defined hole communicating with both the first opening and second opening. The collar is connected to the showerhead body and the controlling valve.

Other objects, advantages and novel features of the invention will become more apparent from the following detailed description when taken in conjunction with the accompanying drawings.

DETAILED DESCRIPTION OF THE PREFERRED EMBODIMENT

Figure 1:
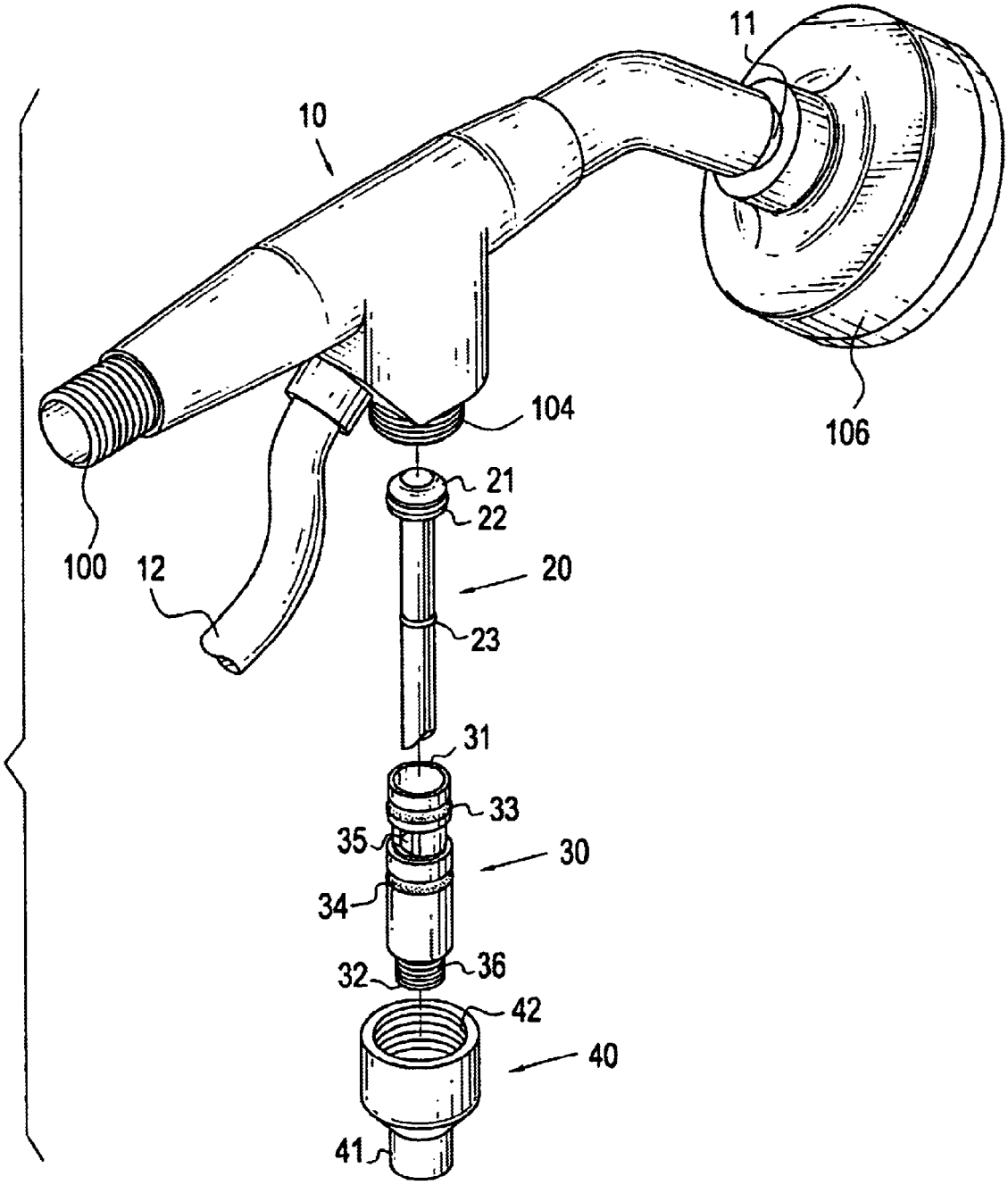
FIG. 1 is an exploded perspective view of the controlling device for a showerhead in accordance with the present invention.
Figure 2:
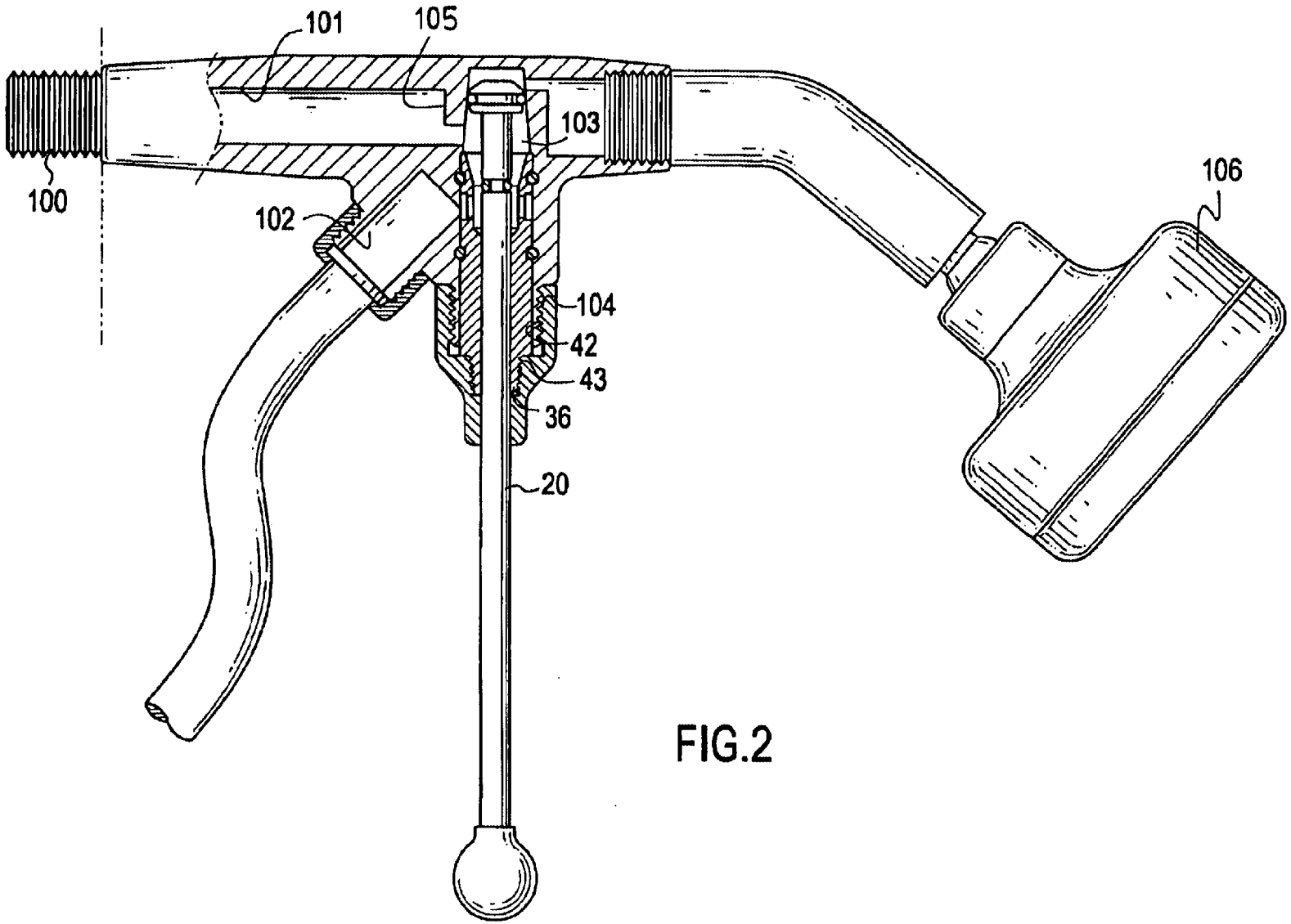
FIG. 2 is a side plan view in partial section of the controlling device for a showerhead in FIG. 1 with the head of the push rod at a position to block communication between the first opening and the radial hole in the controlling valve.

With reference to FIGS. 1 and 2, the showerhead used with the controlling device of the present invention comprises a body (10), a first outlet (11), an inlet (100) and a second outlet (12). The first outlet (11) is connected to a shower nozzle (106). The inlet (100) is defined to allow running water to flow into the body (10). The second outlet (12) is defined below the first outlet (11) and is connected to a water dispenser (not shown).

The body (10) further has a main passage (101), a second passage (102) and a bottom hole (103). The main passage (101) provides a path from the inlet (100) to the first outlet (11) and the second passage (102). The second passage (102) communicates with the main passage (101) at a joint (not numbered) and is defined between the main passage (101) and the second outlet (12) to provide a path between the main passage (101) and the second outlet (12). The bottom hole (103) has a main thread (104) formed on an outer periphery defining the bottom hole (103). A baffle (105) is formed in the main passage (101) at the joint between the main passage (101) and the second passage (102) to partially block the main passage (101) to the first outlet (11). Preferably, the baffle (105) is formed on an upper portion of the joint so that only a lower portion of the main passage (101) communicates with the second passage (102).

The controlling device in accordance with the present invention includes a push rod (20), a controlling valve (30) and a collar (40).

The push rod (20) has a head (21) and a shaft (not numbered). A first seal (22) is mounted around the head (21), and a second seal (23) is mounted around the shaft.

The controlling valve (30) is hollow and has a first opening (31), a second opening (32) and a radial hole (35). The first opening (31) has an enlarged inner diameter so the second seal (23) around the head (21) can firmly press against the inside of the controlling valve (30). The second opening (32) communicates with the first opening (31). The radial hole (35) is radially defined in the controlling valve (30) to communicate with both the first opening (31) and second passage (102). A third seal (33) is mounted around an outer periphery of the controlling valve (30) between the radial hole (35) and the first opening (31). A fourth seal (34) is mounted around the outer periphery of the controlling valve (30) between the radial hole (35) and the second opening (32). A first thread (36) is formed around an outer periphery defining the second opening (32).

The collar (40) has a neck (41), a second thread (42) and a third thread (43). The neck (41) is integrally formed with the collar (40). The second thread (42) is formed on an inner periphery of the collar (40) to correspond to the main thread (104) on the showerhead body (10). The third thread (43) is formed on an inner periphery defining the neck (41) to correspond to the first thread (36) on the controlling valve (36).

Before the controlling device is assembled with the showerhead body (10), the shaft of the push rod (20) is passed through the hollow controlling valve (30) and the collar (40) and the head (21) is securely attached to the shaft. Because the head (21) has a diameter larger than the inner diameter of the first opening (31), the push rod (20) is supported by the controlling valve (30). Then the first thread (36) is screwed into the third thread (43) in the collar (40) to attach the controlling valve (30) to the collar (40). After the assembly of the controlling device, the controlling device is then inserted into the bottom hole (103) in the showerhead body (10), and the second thread (42) is screwed onto the main thread (104) to attach the controlling device to the showerhead body (10).

Figure 3:
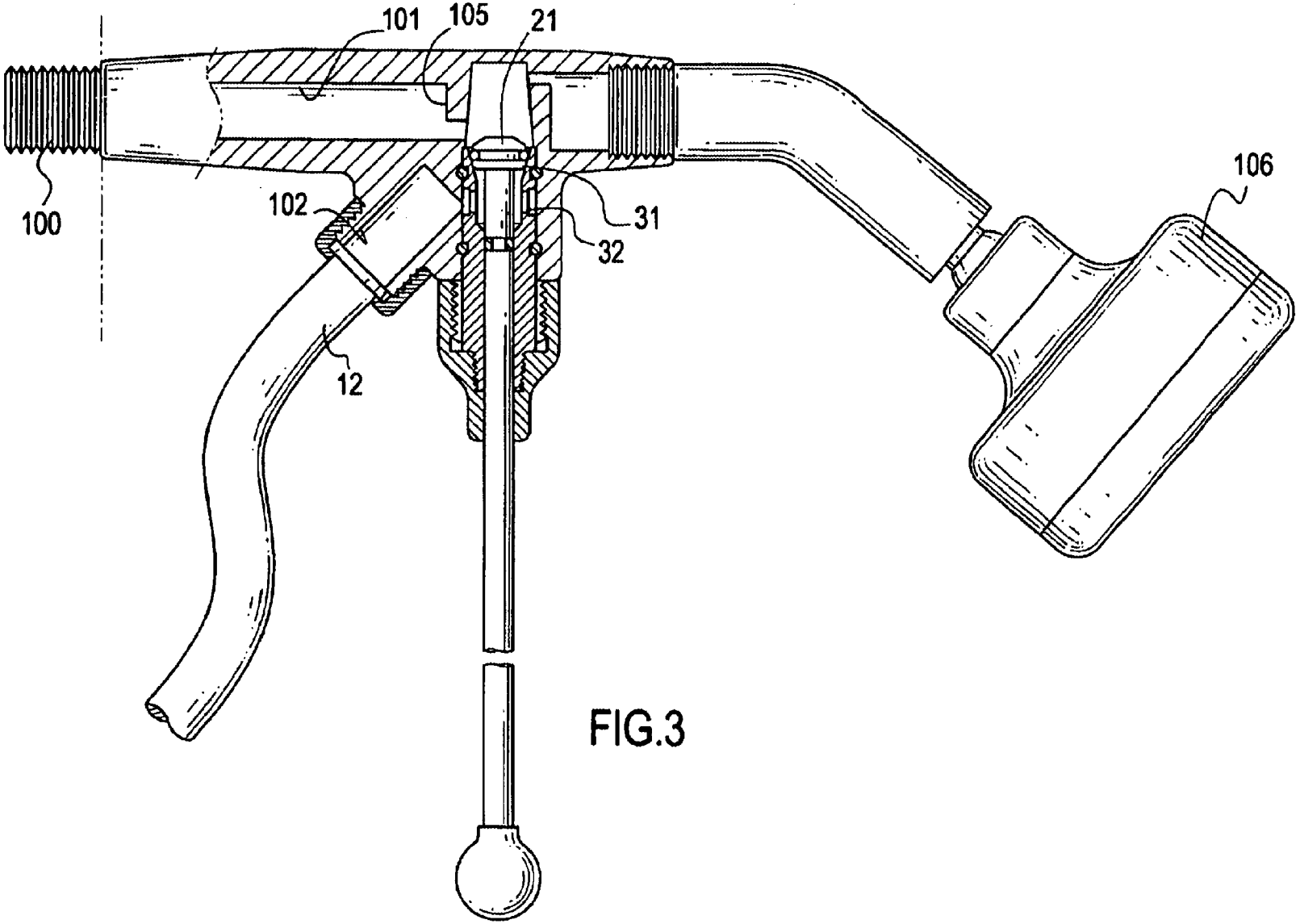
FIG. 3 is a side plan view in partial section of the controlling device for a showerhead in FIG. 1 with the head of the push rod located at a position to establish communication between the first opening and the radial hole in the controlling valve.

With reference to FIG. 3 and still taking FIG. 2 for reference, the rod (20) is in a first position when the head (21) is seated in the first opening (31) of the controlling valve (30). In the first position, the first seal (22) mounted around the head (21) presses firmly against the first opening (31), and the head (21) and first seal (22) block the path between the main passage (101) and the radial hole (35). Consequently, water flowing into the showerhead body (10) from the inlet (100) can only flow to the first outlet (11) and eventually out of the showerhead body (10) through the shower nozzle (106).

When the push rod (20) is pushed, the head (21) moves upward away from the first opening (31) into a second position with the head (21) and first seal (22) pressing against the baffle (105), which blocks a passage (106) defined in the baffle (105) to provide a path between the main passage (101) and the first outlet (11). With the head (21) in the second position, the path between the first opening (31) and the radial hole (35) is restored. Consequently, water flowing from the inlet (100) into the main passage (101) flows to the first opening (31) and the second passage (102) and eventually out of the showerhead body (10) through the second outlet (12). With the head (21) and the second seal (22) in the second position, the main passage (101) to the first outlet (11) is blocked.

Figure 4:
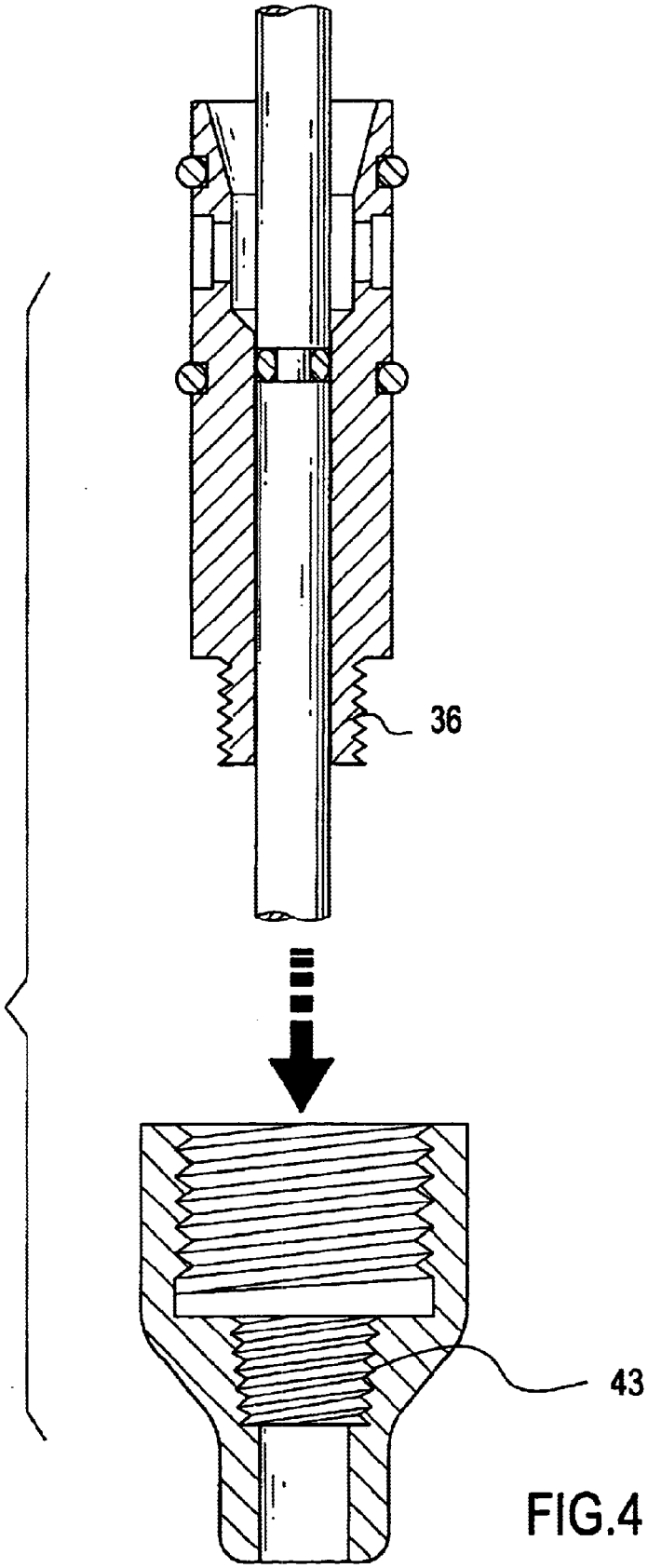
FIG. 4 is an exploded cross sectional view of the controlling valve and the collar in FIG. 1 to show that the inner diameter of the third thread in the collar is tapered.
Figure 5:
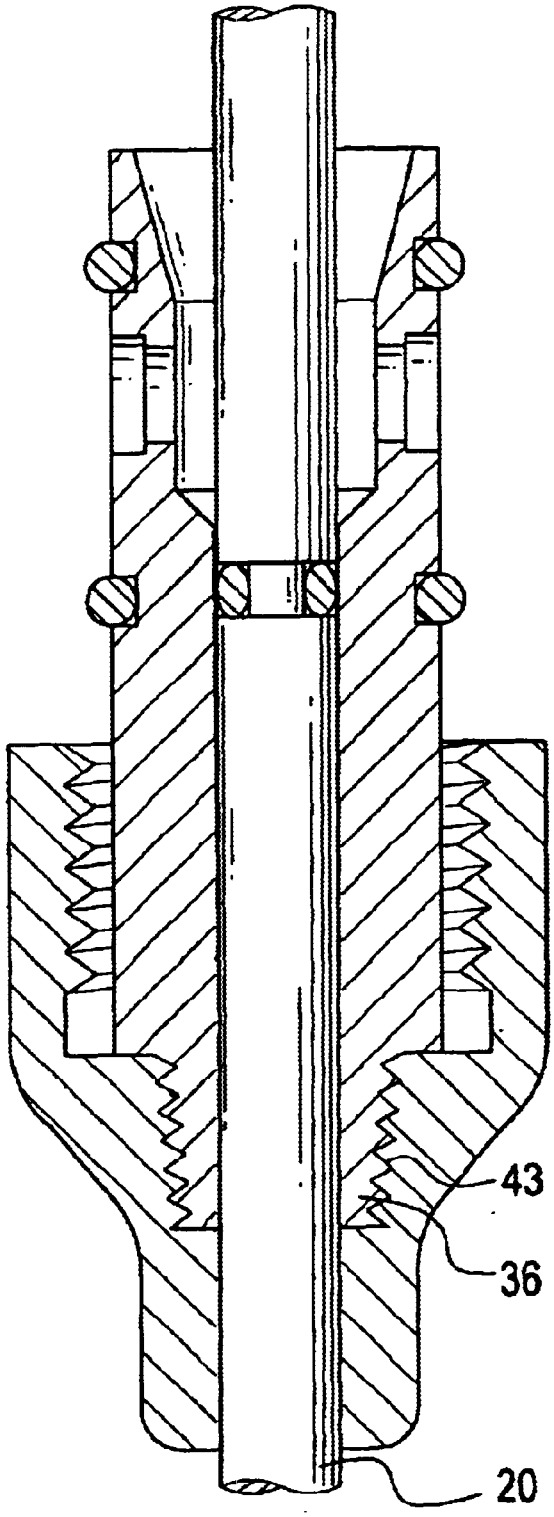
FIG. 5 is a cross sectional view of the controlling valve and the collar in FIG. 4.

With reference to FIGS. 4 and 5, a clamping feature is provided in the controlling device to hold the push rod (20) when the head (21) is in the second position. The clamping device comprises the first thread (36) on the controlling valve (30) and a tapered third thread (43) in the collar (40). Because the controlling valve (30) is plastic, the inner diameter corresponding to the first thread (36) is reduced when the first thread (36) is screwed into the third thread (43). Consequently, friction between the push rod (20) shaft and an inner periphery of the controlling valve (30) increases. The increased friction provides the necessary support to the push rod (20) when the push rod (20) advances from the first position to the second position.

Figure 6:
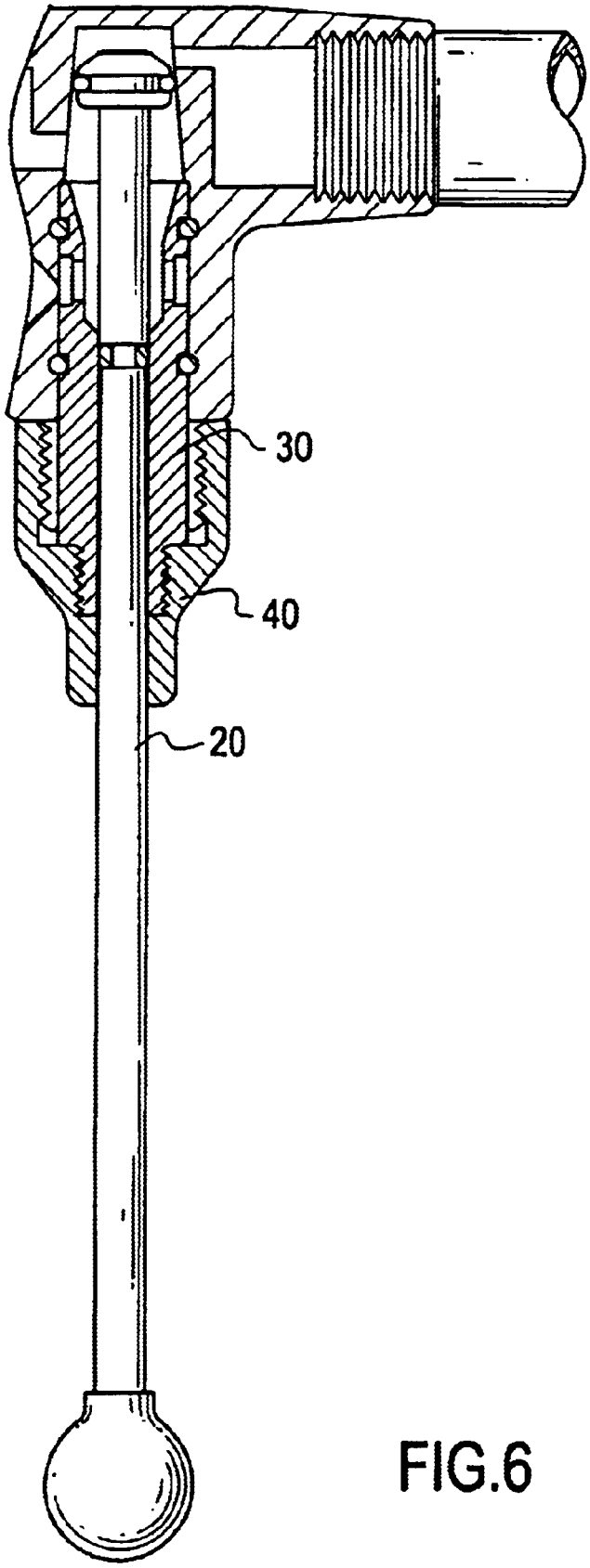
FIG. 6 is a side plan view of the controlling valve and the collar in FIG. 1 showing that the outer diameter of the push rod is tapered.
Figure 7:
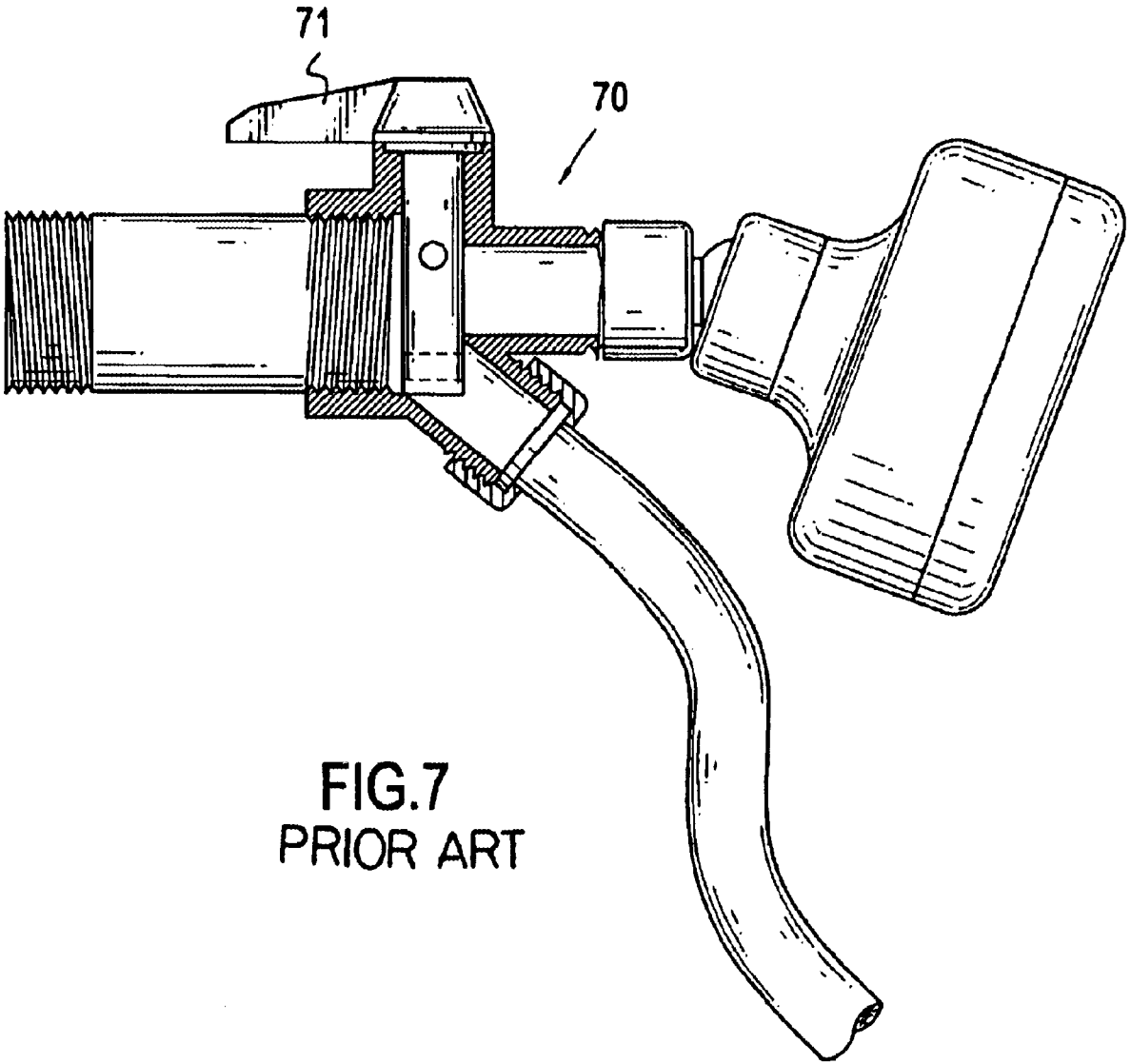
FIG.7 PRIOR ART
FIG. 7 is a side plan view in partial section of a conventional controlling device for a showerhead in accordance with the prior art.

With reference to FIG. 6, the clamping feature is implemented in another preferred embodiment of controlling device by tapering an outer diameter of the push rod (20) shaft. Consequently, the tapered outer diameter increases the friction with the inner periphery of the controlling valve (30) when the push rod (20) is pushed away from the first position. Again the increased friction provides the necessary support to the push rod (20) at the second position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A controlling device for a showerhead having a body, a first outlet connected to a shower nozzle, an inlet defined to allow running water to flow into the body, a second outlet defined below the first outlet, a main passage defined in the body to provide a path between the inlet, the first outlet and the second outlet, a second passage defined between the main passage and the second outlet to provide a path between the main passage and the second outlet, a bottom hole with a main thread formed on an outer periphery defining the bottom hole and a baffle formed in the main passage and located at a joint between the main passage and the second passage to partially block the communication between the main passage and the first outlet, the controlling device comprising:

a controlling valve which is hollow and has a first opening, a second opening communicating with the first opening and an radial hole defined in a side face of the controlling valve to communicate with the first opening and the second passage;

a collar in combination with the controlling valve and adapted to connect to the body and having a neck integrally formed with the collar;

a push rod having a shaft and a head with the shaft extending through the controlling valve and the collar and the head attached to a distal end of the shaft to be movable between a first position and a second position; and a clamping feature provided between the collar and the controlling valve to provide a force to support the push rod when the push rod is moved from the first position to the second position, wherein the head has an outer diameter larger than an inner diameter of the first opening so that when the head is seated in the first opening, the first position, the communication between the first opening and the radial hole is blocked by the head and thus water flows to the first outlet, and when the head is moved from the first position to the second position, the path between the first opening and the radial hole is restored and thus water flows out of the body from the second opening via the second passage.

2. The controlling valve as claimed in claim 1, wherein the clamping feature is implemented by a first thread formed on an outer periphery defining the second opening of the controlling valve and a second thread formed on an inner periphery defining the neck to correspond to the first thread, wherein the second thread is tapered so that an inner diameter of the first thread reduces when the second thread screws onto the first thread and thus friction between an inner periphery of the controlling valve and an outer periphery of the push rod increases so the push rod is supported when the push rod is at the second position.

3. The controlling device as claimed in claim 2, wherein an outer diameter of the push rod shaft is tapered so that the push rod is supported by the controlling valve when the push rod is moved to the second position.

4. The controlling device as claimed in claim 3, wherein the baffle has a passage defined therein to be selectively blocked by the head of the push rod.

5. The controlling device as claimed in claim 1, wherein the baffle has a passage defined therein to be selectively blocked by the head of the push rod.

6. The controlling device as claimed in claim 1, wherein an outer diameter of the push rod shaft is tapered so that the push rod is supported by the controlling valve when the push rod is moved to the second position.

7. The controlling device as claimed in claim 6, wherein the baffle has a passage defined therein to be selectively blocked by the head of the push rod.

* * * * *